United States Patent [19]

Kochevar et al.

[11] 4,025,231

[45] May 24, 1977

[54] PROPELLER FAN CONSTRUCTION

[75] Inventors: Joseph F. Kochevar; Richard M. Rath, both of Dundee; Walter W. Claffey, Barrington, all of Ill.

[73] Assignee: Revcor, Inc., Carpentersville, Ill.

[22] Filed: Nov. 26, 1975

[21] Appl. No.: 635,765

[52] U.S. Cl. ..... 416/144; 416/236 R; 416/DIG. 3

[51] Int. Cl.[2] ..... F04D 29/38

[58] Field of Search ..... 416/DIG. 3, 210, 132 A, 416/144, 145, 236

[56] References Cited

UNITED STATES PATENTS

| | | | |
|---|---|---|---|
| 1,313,598 | 8/1919 | Ingells | 416/240 X |
| 1,352,848 | 9/1920 | Stanyo | 416/236 X |
| 1,634,554 | 7/1927 | Pajalic | 416/DIG. 3 |
| 1,806,539 | 5/1931 | Cram | 416/236 X |
| 1,868,528 | 7/1932 | Gardner | 416/DIG. 3 |
| 2,581,873 | 1/1952 | Morrison | 416/DIG. 3 |
| 2,794,509 | 6/1957 | Mix | 416/214 |
| 2,965,180 | 12/1960 | Killam | 416/236 A |
| 3,315,750 | 4/1967 | Delaney | 416/144 |
| 3,910,718 | 10/1975 | MacEwen et al. | 416/132 |

FOREIGN PATENTS OR APPLICATIONS

| | | | |
|---|---|---|---|
| 606,617 | 10/1960 | Canada | 416/DIG. 3 |
| 12,846 | 6/1909 | United Kingdom | 416/210 |
| 1,272,645 | 5/1972 | United Kingdom | 416/DIG. 3 |

*Primary Examiner*—Everette A. Powell, Jr.
*Attorney, Agent, or Firm*—Neuman, Williams, Anderson & Olson

[57] ABSTRACT

A propeller fan construction is provided in which the impeller thereof includes a spider member having a plurality of symmetrically arranged planar marginal portions, and a plurality of blades projecting outwardly from the spider member. Each blade has an inner end provided with a planar segment which is fixedly mounted on a planar marginal portion of the spider member. The spider member and each of the blades are formed of sheet material. Each blade is provided with an elongated embossment extending from one elongated edge of the blade in an angular direction relative to the longitudinal axis of the blade. The embossment is position between the outer end of the blade and the planar segment of the inner end.

6 Claims, 12 Drawing Figures

PROPELLER FAN CONSTRUCTION

BACKGROUND OF THE INVENTION

In a heavy duty, industrial-type propeller fan construction it has heretofore been customary for the impeller thereof to embody a solid steel center piece to which a plurality of symmetrically arranged blades of sheet steel are affixed. The blades in such a construction are twisted so as to impart a desired pitch thereto relative to the plane of rotation. Such an arrangement, however, is in contrast to the conventional, light duty fan construction wherein the center piece, or spider member, of the impeller is provided with a plurality of wings or extensions twisted so as to impart a pitch to the flat blades which are affixed thereto. It has been found in the latter type of construction that the operating efficiency thereof is in the order of 40–50%. In the heavy duty propeller fan construction, as aforedescribed, the operating efficiency thereof is also very poor. The poor efficiency in these prior constructions are deemed attributable to one or more of the following factors: a) the various components of the impeller have an inordinate amount of weight thereby requiring greater horsepower input to effect rotation of the impeller, b) power loss results from an excessive turbulent air condition being created in the vicinity of the spider member, particularly where the latter is a solid steel plate, c) an undesirable air stall condition is produced in the vicinity of the blade outer ends due to the amount of clearance of the outer ends with respect to the opening or housing in which the propeller fan is placed, and d) proper balancing of the fan impeller was difficult to attain.

With regard to balancing of the fan impeller, particularly in the larger size units, it was customary to apply predetermined weights on the blades by welding or riveting, which involved special equipment and was a costly and time-consuming operation.

SUMMARY OF THE INVENTION

Thus, it is an object of the invention to provide a propeller fan construction which readily overcomes the aforenoted shortcomings besetting prior fan constructions of this general type.

It is a further object of the invention to provide a propeller fan construction wherein both the spider member and the blades of the impeller are formed from lighter weight sheet material than is normally required without adversely effecting the rating of the fan.

It is a still further object of the invention to provide a propeller fan construction wherein the impeller blades are of like configuration and readily interchangeable, and balancing weights may be applied thereto or removed therefrom without the need for special tools or equipment and without marring or permanently defacing the blade surface.

Further and additional objects will appear from the description, accompanying drawings and appended claims.

In accordance with one embodiment of the invention, a propeller fan construction is provided in which the impeller thereof comprises a spider member having a plurality of symmetrically arranged planar marginal portions, and a plurality of elongated blades fixedly secured to the marginal portions of the spider member and extending substantially radially therefrom. Each blade has an inner end with a planar segment which is disposed in face-to-face relation with a planar marginal portion of the spider member. An elongated embossment is formed in the blade which extends from one elongated edge of the blade in an angular direction relative to the longitudinal axis of the blade.

DESCRIPTION

For a more complete understanding of the invention reference should be made to the drawings wherein.

Figure 1:
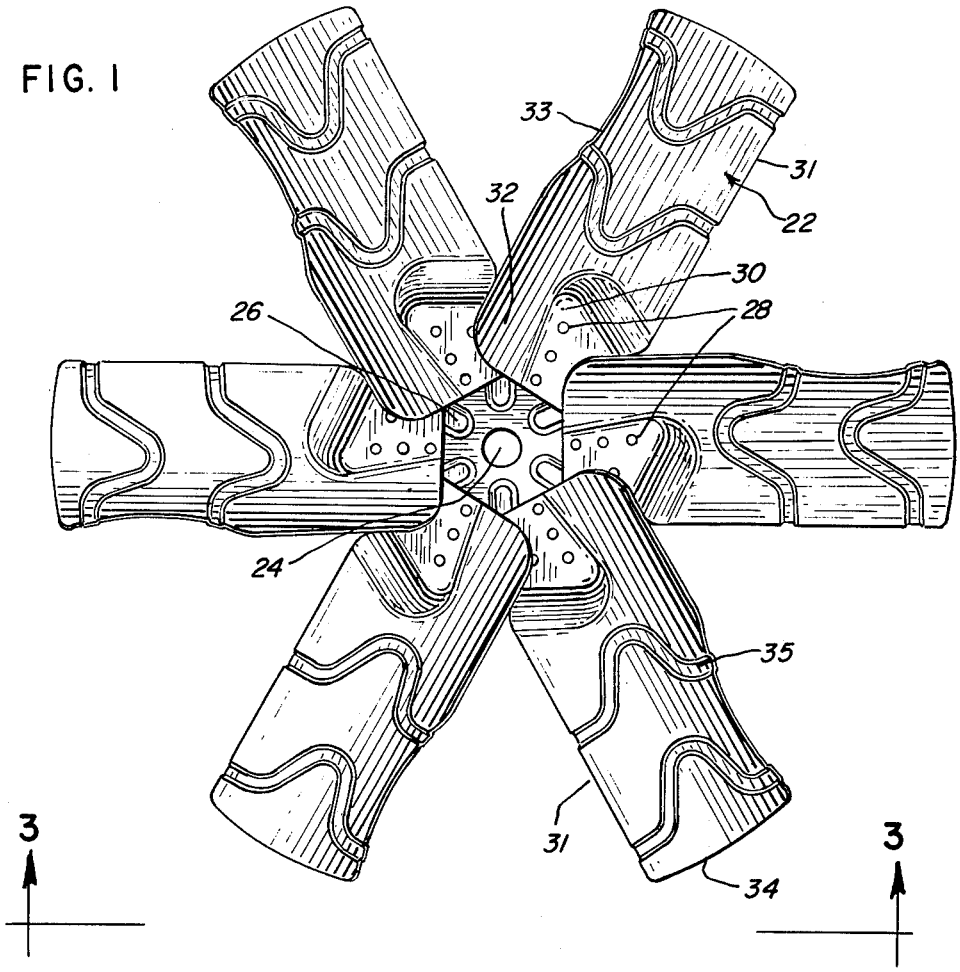
FIG. 1 is a front elevational view of one form of the improved fan impeller.
Figure 3:
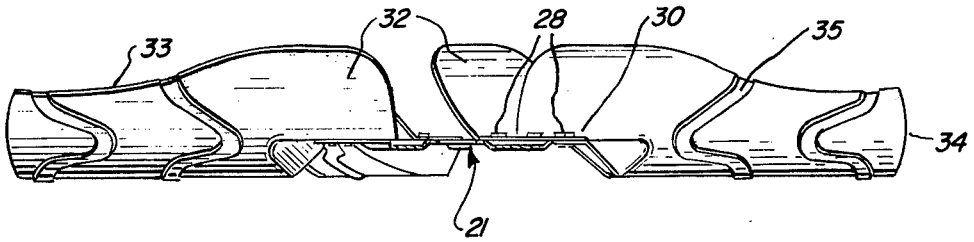
FIG. 3 is a side elevational view of the fan impeller of FIG. 1.
Figure 2:
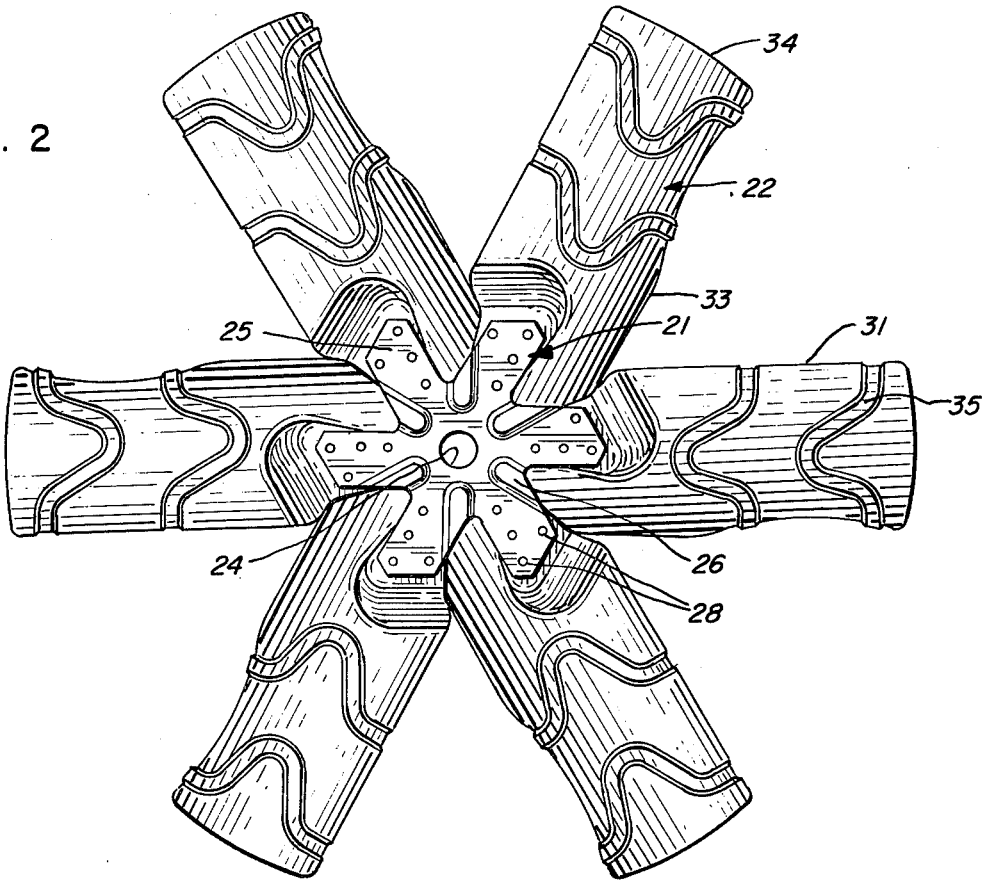
FIG. 2 is a rear elevational view of the fan impeller of FIG. 1.
Figure 8:
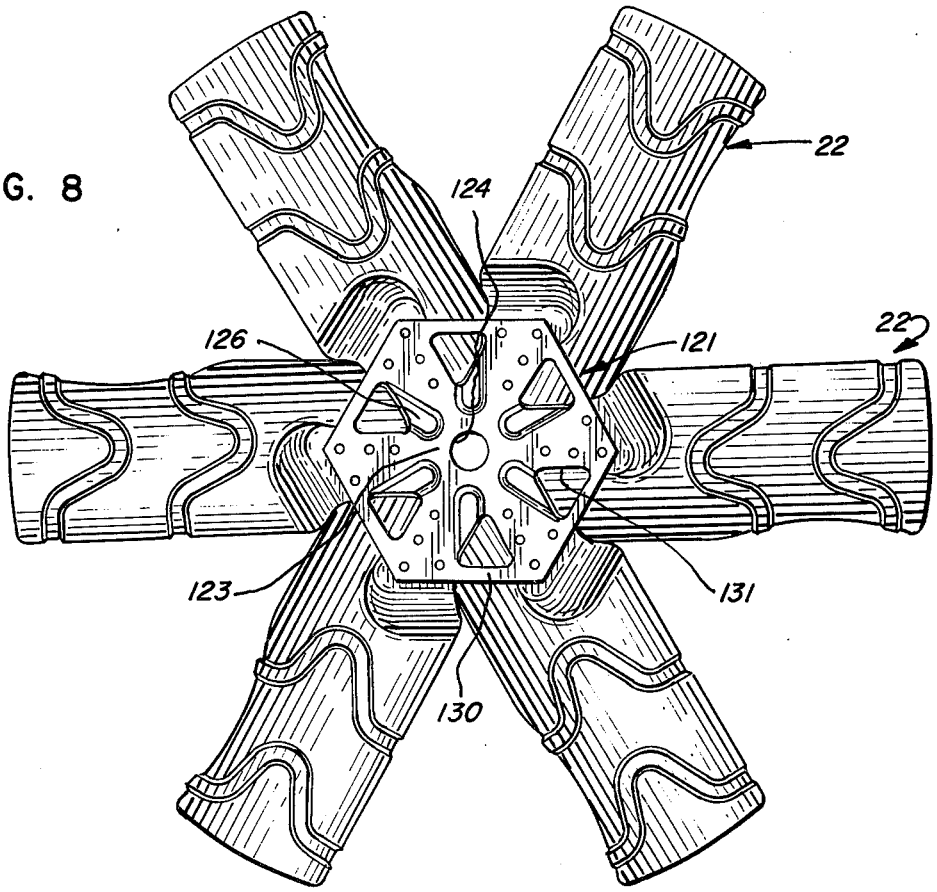
FIG. 8 is similar to FIG. 2 but showing a modified form of spider member.

Referring now to the drawings and more particularly to FIGS. 1–3, one form of the improved impeller 20 for a propeller fan construction is shown which is adapted to be mounted on a motor drive shaft, not shown. The impeller 20 includes a spider member 21 and a plurality of symmetrically arranged blades 22 which are affixed to the spider member and project outwardly therefrom.

Figure 6:
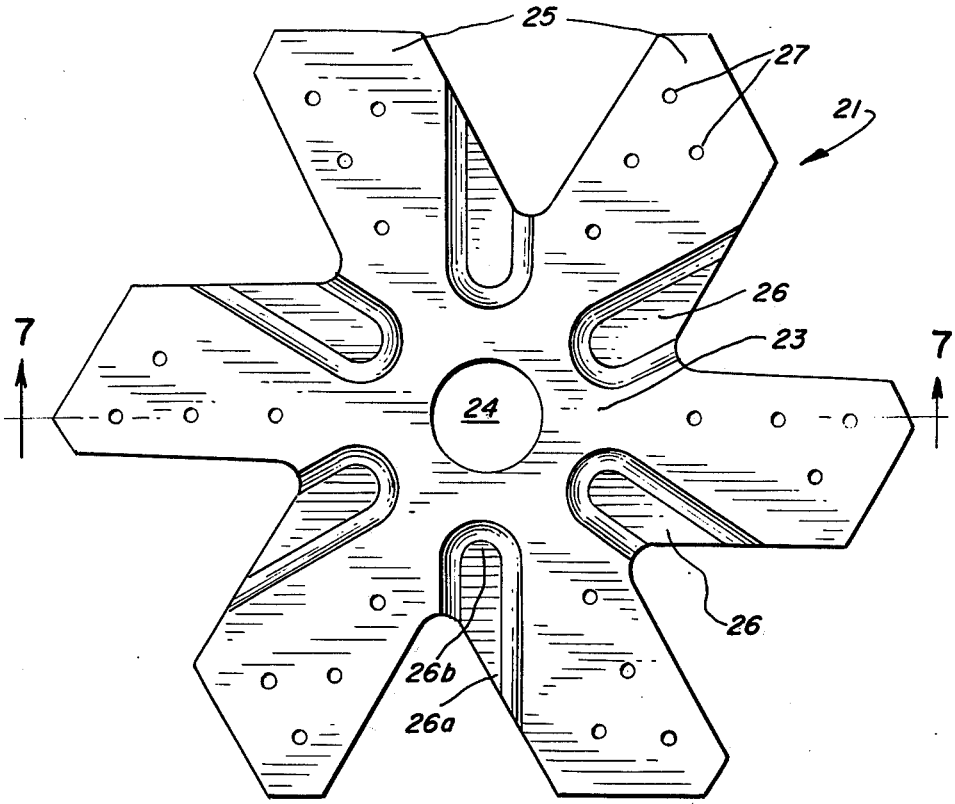
FIG. 6 is an enlarged front elevational view of the spider member shown in FIG. 1.
Figure 7:
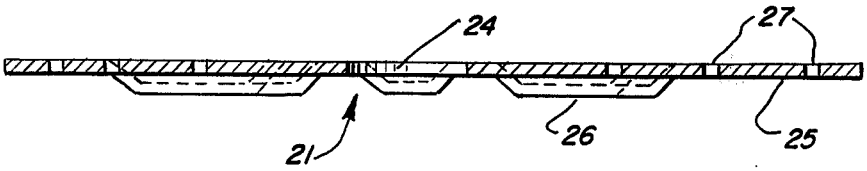
FIG. 7 is a sectional view taken along line 7—7 of FIG. 6.

As seen in FIGS. 6–7, the spider member 21 has a center portion 23 provided with a central opening 24 for accommodating the end of the drive shaft. Projecting outwardly from the center portion 23 of the spider member are a plurality of symmetrically arranged marginal portions or arms 25. In the illustrated embodiment the center portion 23 and the arms 25 are of substantially planar construction and disposed in coplanar relation. To provide added strength and stiffness to the spider member, the center portion 23 thereof is provided with a plurality of substantially radially disposed elongated embossments 26. The embossments are located generally between adjacent arms 25; however, in the illustrated embodiment, each embossment has the outer end **26*a* thereof terminating within one of the adjacent arms. The opposite, or inner, end 26*b* of each embossment, on the other hand, terminates within the center portion 23 and is spaced a predetermined distance from the periphery of opening 24 so that a planar area of the center portion 23 is circumjacent the opening. Each of the arms 25 is provided with a plurality of apertures 27 which are adapted to accommodate suitable fasteners 28 for securing to the arm one of the blades 22, see FIG. 1. The shape and number of arms 25 projecting from the center portion 23 may vary from that shown in FIG. 6, if desired. By reason of the embossments 25**, a lighter-weight sheet metal may be utilized in forming the spider member without sacrificing the required strength needed for the member.

Figure 4:
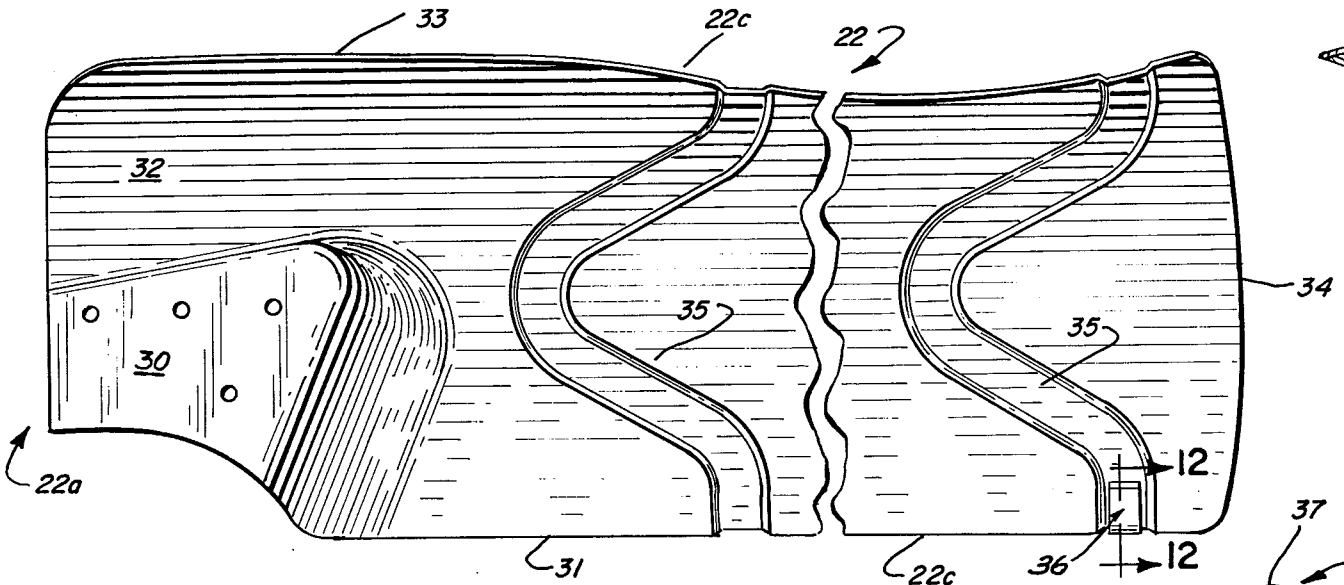
FIG. 4 is an enlarged fragmentary plan view of one of the blades of FIG. 1 and showing a balancing weight mounted thereon.

The blades 22 are interchangeable, of like configuration, and are formed of light-weight sheet metal. Referring to FIG. 4, it will be noted that each blade 22 has an inner end 22*a* which is provided with a plateau-like, planar segment 30 offset relative to the longitudinal axis of the blade towards the leading edge 31 thereof. A second segment 32 of the inner end of the blade curves upwardly and rearwardly from the planar segment 30 towards the trailing edge 33 of the blade. The leading edge 31 of the blade has a generally straight profile while the trailing edge 33 is generally contoured, as seen in FIG. 4.

The planar segment 30 of the inner end of the blade is provided with a plurality of apertures 30*a* which are arranged in the same pattern as the apertures 27 in the arms 25 of the spider member 21.

Formed within the portion 22*c* of the blade and disposed between the planar segment 30 and the outer end 34, is one, or more, embossments 35. Each embossment is of tortuous configuration and imparts both lateral and longitudinal strength and stiffness to the blade. Each embossment extends from the leading edge across to the trailing edge of the blade. The number, shape and size of the embossments may be varied from that shown and will depend upon the amount of strength and stiffness required.

Figure 5:
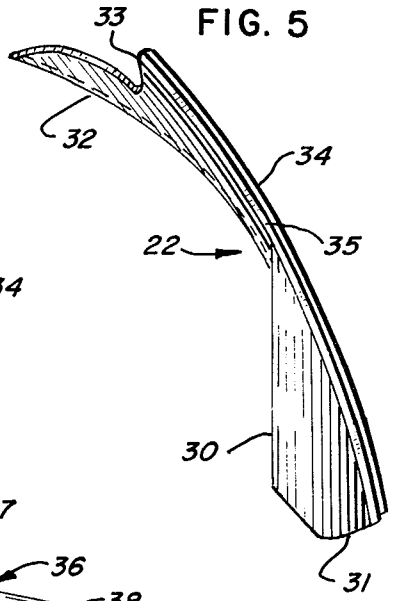
FIG. 5 is an enlarged right-hand end view of the blade of FIG. 4.

As seen from FIG. 5, the blade 22 has a concavo-convex cross-sectional configuration with the curvature of the blade being maximum adjacent the planar segment 30 of the inner end and minimum adjacent the outer end of the blade.

Figure 9:
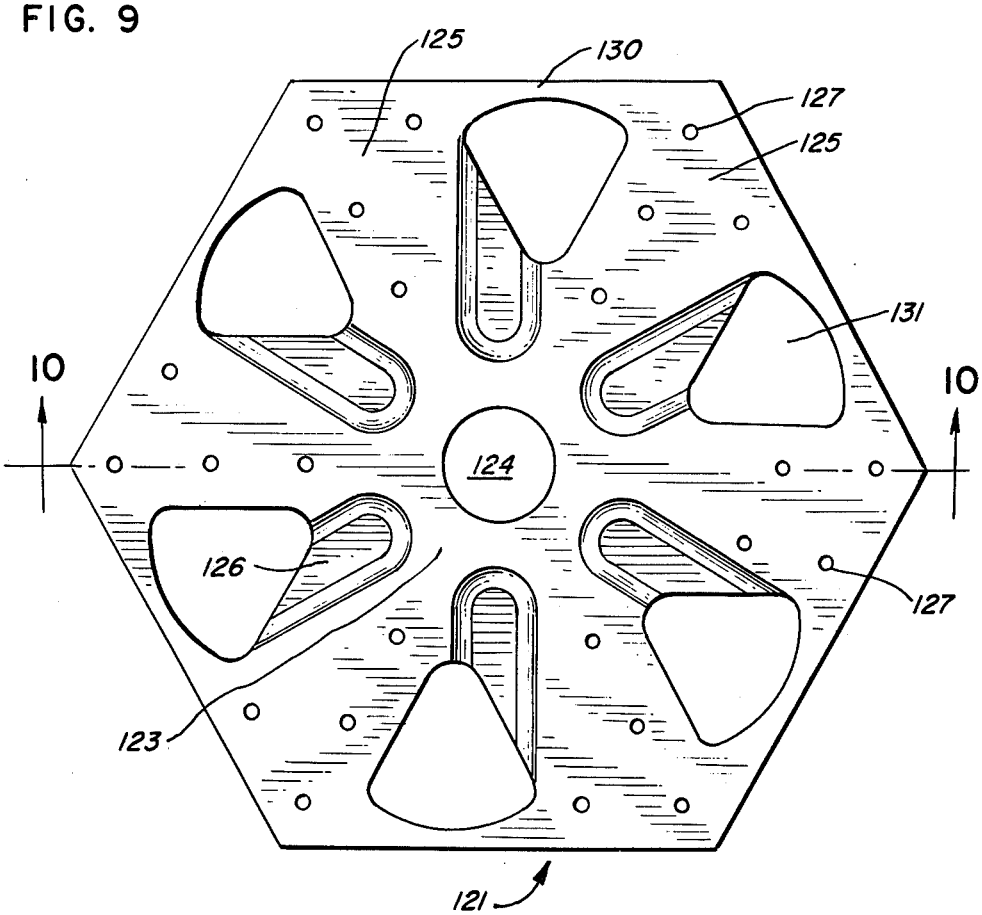
FIG. 9 is an enlarged front elevational view of the modified spider member shown in FIG. 8.
Figure 10:
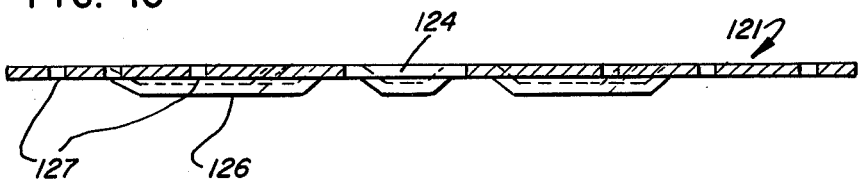
FIG. 10 is a sectional view taken along line 10—10 of FIG. 9.

FIGS. 9 and 10 disclose a modified form of spider member 121 which is similar to spider member 21, except that the outer portions of adjacent extensions 125 are interconnected by a bridge section 130. Portions of spider member 121 which correspond to portions of spider member 21 have been identified by like numerals except in a 100 series. The bridge sections 130 provide greater strength for the spider member 121. The voids 131 delimited by the extensions 125 eliminate excessive air turbulence in the vicinity of the spider member and increase efficiency. The voids 131 and bridge sections 130 help to reduce the weight of the spider member. As in the case of spider member 21, spider member 121 is formed from sheet metal and is provided with a plurality of reinforcing embossments 126. Except for the embossments, spider member 121 is of planar configuration.

Figure 11:
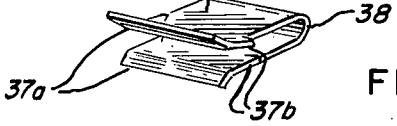
FIG. 11 is an enlarged perspective view of one form of balancing weight.
Figure 12:
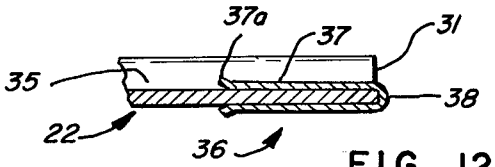
FIG. 12 is an enlarged sectional view taken along line 12—12 of FIG. 4.

In order to properly balance the blades, weights 36 in the form of clips may be utilized, see FIGS. 4, 11 and 12. Each weight 36 is provided with a pair of resilient legs 37 which are interconnected at one end by a bail portion 38. The opposite ends 37*a* of the legs are flared outwardly a slight amount so as to facilitate mounting of the weights on selected blades. Barbs 37*b* are formed in legs 37 which serve to increase the friction between the legs and the blade. The width of each weight is sized so that it can be positioned within and at the end of one of the embossments 35 formed in the blade. Because of this arrangement, the side of the embossment will resist the centrifugal forces exerted on the weight when the fan impeller is rotating and, thus, obviate the need for securing the weight in place by welding, riveting or the like. The weight may be assembled on the blade by manually pushing or hammering it in place, see FIG. 12.

Thus, an improved propeller fan construction has been provided wherein the impeller thereof is of simple, light-weight construction, is highly efficient in operation with efficiencies in the order of 65% or better, and the components thereof may be readily assembled. The size and shape of the various components might be varied from that shown without departing from the scope of the invention.

We claim:

1. In a propeller fan construction, an impeller therefor comprising a spider member mountable for rotation about a central axis, said spider member having a plurality of planar marginal portions arranged symmetrically relative to the central axis; a plurality of elongated blades formed of sheet material and having corresponding inner ends thereof provided with planar segments fixedly mounted in face-to-face relation on the planar marginal portions of said spider member, corresponding outer ends of said blades being spaced radially outwardly from the periphery of said spider member, each blade being provided with an elongated embossment disposed intermediate the inner and outer ends of said blade and extending from an elongated edge of the blade angularly relative to the longitudinal axis of said blade, each embossment forming a recess on one surface of the blade; and weighted elements in gripping engagement on selected blades and being aligned with predetermined embossments thereof, each weighted element including a pair of resilient interconnected legs grippingly straddling an edge portion of the selected blade, one leg of the pair being disposed within the embossment recess.

2. The impeller of claim 1 wherein the embossment of each blade extends from an elongated leading edge of the blade to an elongated trailing edge of said blade; and the leg of each weighted element having a width corresponding substantially to the width of the embossment recess in which it is disposed.

3. The impeller of claim 1 wherein each blade is provided with a pair of elongated embossments disposed in spaced relation intermediate the inner and outer ends of said blade.

4. The impeller of claim 1 wherein each blade inner end has a planar first segment offset towards the elongated leading edge of said blade and an upwardly curved second segment extending from said planar first segment to an elongated trailing edge of said blade; the marginal portions of said spider member being disposed in a common plane positioned transversely of the central axis.

5. The impeller of claim 1 wherein the spider member includes a center portion and a plurality of elongated extensions projecting substantially radially from said center portion, each extension embodying a planar marginal portion to which the inner end planar segment of a blade is fixedly mounted; the center portion of said spider member being provided with a plurality of substantially radially extending embossments, each of said spider member embossments being disposed substantially intermediate a pair of adjacent extensions.

6. The impeller of claim 5 wherein the outer ends of adjacent extensions are interconnected by elongated bridge sections.

* * * * *